United States Patent [19]

Klimpert et al.

[11] Patent Number: 4,565,537

[45] **Date of Patent: * Jan. 21, 1986**

[54] IMPACT RESPONSIVE TOY

[75] Inventors: Randall J. Klimpert, Chicago; Burton C. Meyer, Downers Grove, both of Ill.

[73] Assignee: Marvin Glass & Associates, Chicago, Ill.

[ * ] Notice: The portion of the term of this patent subsequent to Apr. 2, 2002 has been disclaimed.

[21] Appl. No.: 533,354

[22] Filed: Sep. 19, 1983

Related U.S. Application Data

[63] Continuation-in-part of Ser. No. 435,555, Oct. 21, 1982, Pat. No. 4,508,521.

[51] Int. Cl.[4] ..... A63H 17/02; A63H 3/12

[52] U.S. Cl. ..... 446/321; 446/353; 446/441; 446/6

[58] Field of Search ..... 46/151, 162, 135 R, 46/116, 201, 221, 222, 212, 263; 446/6, 321, 353, 441

[56] References Cited

U.S. PATENT DOCUMENTS

| | | | |
|---|---|---|---|
| 243,752 | 7/1881 | Bartenstein . | |
| 1,120,456 | 12/1914 | Devall | 46/135 R |
| 1,247,989 | 11/1917 | Mulock | 446/4 |
| 1,555,644 | 9/1925 | Duncan . | |
| 2,208,219 | 7/1940 | Maibaum | 46/135 R |
| 2,457,653 | 12/1948 | Froelich | 446/4 |
| 2,584,798 | 2/1952 | Goerditz | 446/321 |
| 2,633,663 | 4/1953 | Fuerst . | |
| 2,669,802 | 2/1954 | Olivier | 46/135 R |
| 2,670,568 | 3/1954 | Walss | 46/135 R X |
| 3,032,921 | 5/1962 | Greene | 446/190 |
| 3,830,012 | 8/1974 | Franke | 46/135 R |
| 3,892,086 | 7/1975 | Gay et al. | 446/465 |
| 4,030,239 | 6/1977 | White et al. | 46/135 R |

*Primary Examiner*—F. Barry Shay

[57] ABSTRACT

An impact responsive toy has a part of the body that is movable to expose the part in its regular condition or in a damaged condition. A biasing force urges exposure of the hidden damaged condition while the part is releasably latched to expose the undamaged or regular position. Application of an outside force, such as the impact of a crash or blow, releases the latch to automatically and instantaneously switch the undamaged and damaged conditions.

20 Claims, 12 Drawing Figures

IMPACT RESPONSIVE TOY

This application is a continuation-in-part of Application Ser. No. 435,555 filed Oct. 21, 1982 now U.S. Pat. No. 4,508,521.

BACKGROUND OF THE INVENTION

1. Field of the Invention

The invention relates to toys such as vehicles and figures having an action feature responsive to impact.

2. Background Art

There are toy vehicles in which a part breaks away or the entire body explodes as a result of the force of a crash on impact. Examples of such break-apart toy vehicles are shown in U.S. Pat. Nos. 3,959,920; 3,734,500; 3,176,429; 2,757,482; and 2,597,094. While spectacular, such prior art toys do not realistically represent the change of appearance resulting from many of the collisions that actually occur involving the real-life vehicles. Moreover, the projecting pieces involved in such assemblies can present hazards and loose pieces tend to become lost. Figures or dolls have been provided with changeable faces or other parts of the body as in U.S. Pat. Nos. 3,538,638; 3,811,220; 4,030,239; and 4,030,240. In none of such prior art toys, however, does the part change appearance in response to impact but rather requires manual changing of the face or appendage, turning a knob or pushing a button.

SUMMARY OF THE INVENTION

The present invention is concerned with providing a toy such as a vehicle or a figure that uses a contained part to realistically represent the results of impact. These and other objects and advantages of the invention are achieved by providing a toy body with a movable part that has sections representing a segment of the body in both the regular and damaged conditions. The part is biased to a position exposing the damaged condition but is releasably latched in another position exposing the undamaged appearance. Upon an impact exerting a force against the part in a manner that would be normally expected in a similar real-life crash or other impact situation, the latch is released and the part is instantly moved to exchange the regular appearance with the damaged appearance.

BRIEF DESCRIPTION OF THE DRAWINGS

For a better understanding of the present invention reference may be had to the accompanying drawings in which.

DETAILED DESCRIPTION OF THE PREFERRED EMBODIMENTS

Figure 1:
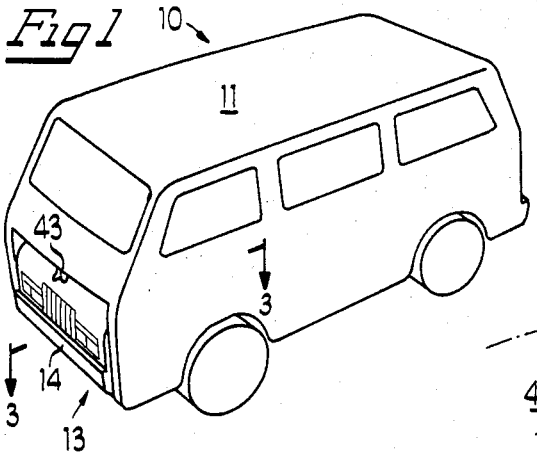
FIG. 1 is a perspective view of a toy vehicle embodying the present invention.

Referring now to the drawings in which like parts are designated by like reference numerals throughout the several views there is shown in FIG. 1 a toy vehicle 10 having a body 11 in which a movable part 13 makes up the front bumper and grill assembly. One section 14 of the part 13 has the normal undamaged bumper and grill assembly while another section 15 has a representation of a damaged or dented bumper and grill.

The part 13 is provided with a central bore 16 and is mounted for revolution about a generally horizontal axis 17 having end stubs 18 and 19. In the position shown in FIGS. 1 and 3–5 the normal section 14 is exposed while the damaged section 15 is hidden by the rest of the body 11. A spring 22 is coiled about the axis 17 with the inside end 23 secured to the stub 18. A slot 24 is provided in the end of stub 18 for insertion and retention of the spring end 23. An axial recess 26 within the part 13 accommodates the spring 22. The other end 27 of the spring is inserted into a slot 28 and secured to part 13.

A frame member 29 for mounting the rotating or revolving part 13 is provided for attachment to the vehicle body 11. However, the part 13 may be mounted directly to the vehicle body 11 as will be apparent from the following description. A rivet 30 or a similar fastener is used to secure the frame 29 to the body 11. Frame 29 has spaced substantially parallel plates 31 and 31 which abut the inside of the front fender well portions of the body 11. Pin projections 33 are received in mating detents on the body 11 to help secure the frame 29.

Figure 6:
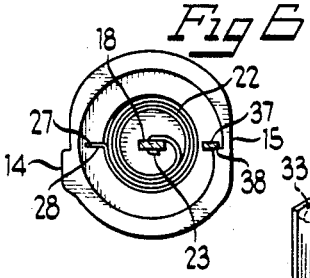
FIG. 6 is an enlarged sectional view taken generally along the line 6—6 of FIG. 3.
Figure 7:
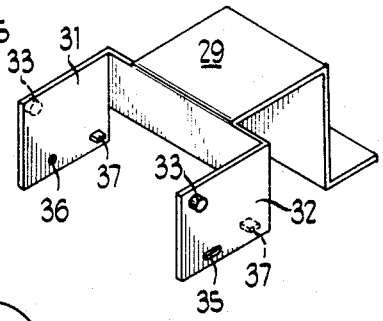
FIG. 7 is an enlarged perspective view of the support frame appearing in FIGS. 3–6.
Figure 8:
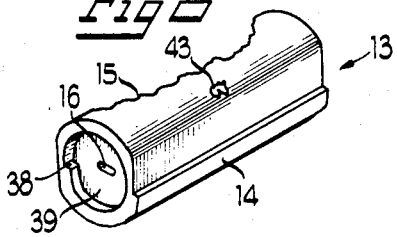
FIG. 8 is an enlarged perspective view of the revolving part appearing in FIGS. 1–4 and 6.
Figure 9:
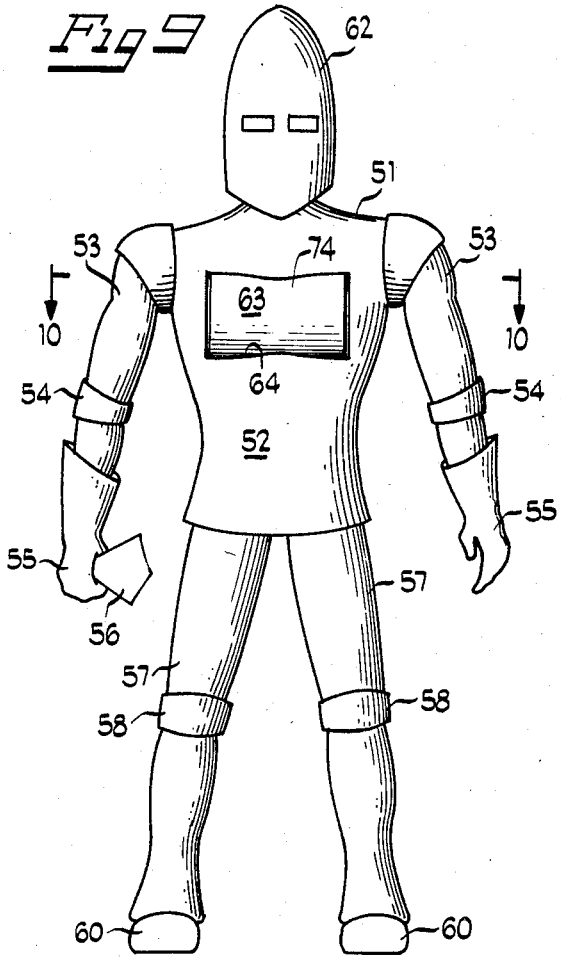
FIG. 9 is a perspective view of a toy figure embodying the present invention.
Figure 11:
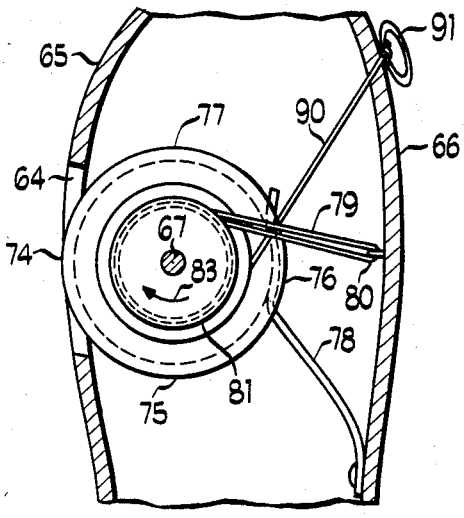
FIG. 11 is an enlarged partial sectional view taken generally along the line 11—11 of FIG. 10.
Figure 12:
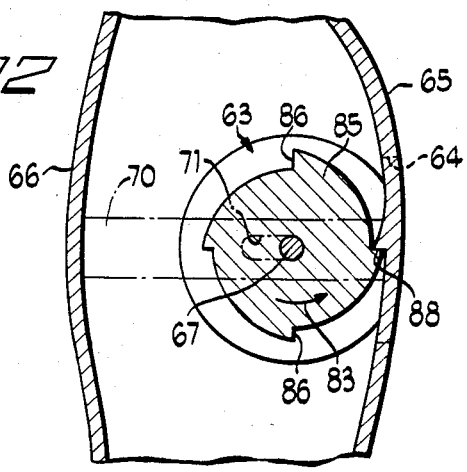
FIG. 12 is an enlarged partial sectional view taken generally along the line 12—12 of FIG. 10.
Figure 10:
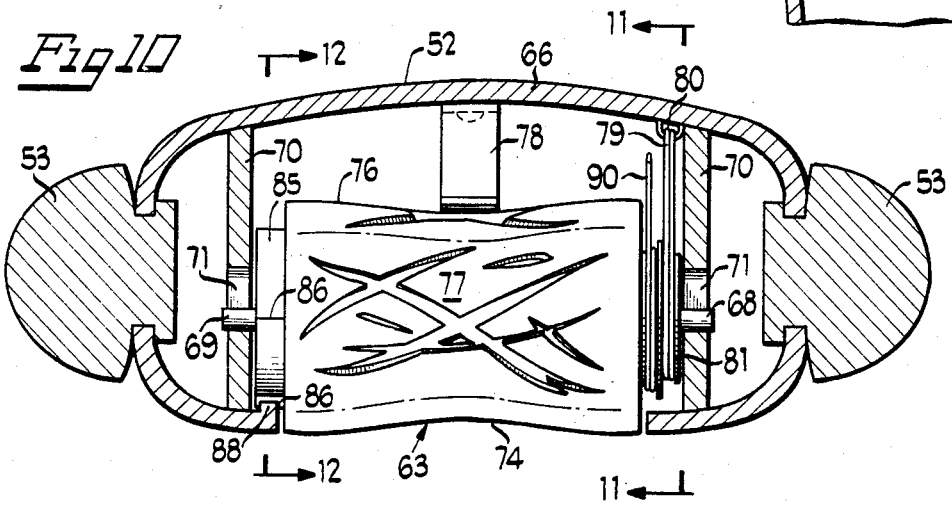
FIG. 10 is an enlarged partial sectional view taken generally along the line 10—10 of FIG. 9.

Each of the stub ends 18 and 19 is received in a respective recess 35 and 36 on the frame 29. Alternatively, such recesses could be provided directly in the inside of the fender well portions of the body 11. As shown in FIG. 6, the end 18 is substantially rectangular as is the receiving recess 35 in order to keep the axis 17 from rotating when the part 13 is revolved. In this embodiment the other stub 19 and its receiving recess 36 are not squared off to facilitate proper assembly.

The spring 22 is wound so that when the cylindrical part 13 is inserted with the damaged section of the grill 15 showing, little if any force is exerted by the spring 22. However, when the part 13 is rotated clockwise to expose the undamaged bumper and grill section 14, the coil spring 22 is wound tighter and exerts a biasing force urging the cylinder 13 to revolve counterclockwise and expose the damaged section.

In order to releasably cock the cylinder 13 in the position exposing the undamaged bumper and grill, a releasable latch or trigger mechanism is provided comprising fixed tabs 37 projecting from the inside of each of the plates 31 and 32. Alternatively, similar tabs could be provided on the body 11 itself. The tabs 37 cooperate with detents 38 formed in the walls of outer axial recesses 39 in the part 13. As the part 13 is rotated clockwise, the detents 38 are rotated into alignment with the tabs 37. A trigger mechanism could also be provided wherein projections on the part 13 cooperate with detents in the frame 29 or the vehicle body 11.

Figure 2:
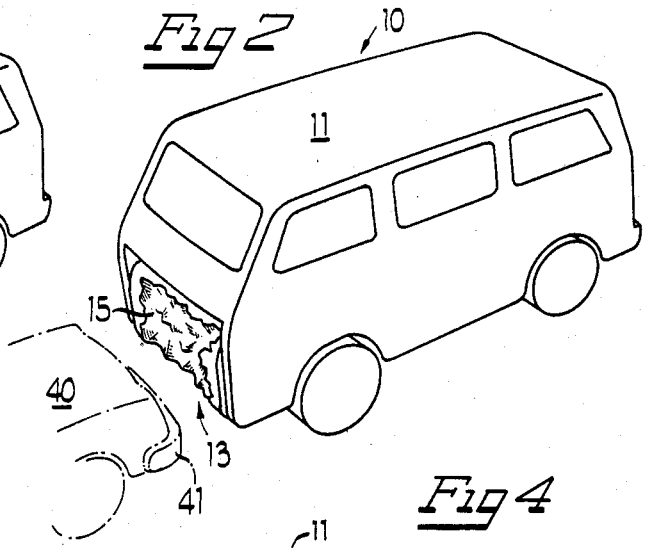
FIG. 2 is another perspective view of the toy vehicle following impact.
Figure 3:
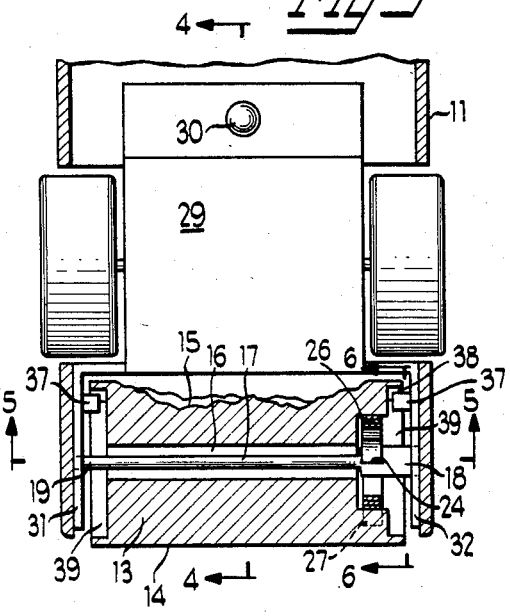
FIG. 3 is an enlarged partial sectional view taken generally along the line 3—3 of FIG. 1.
Figure 4:
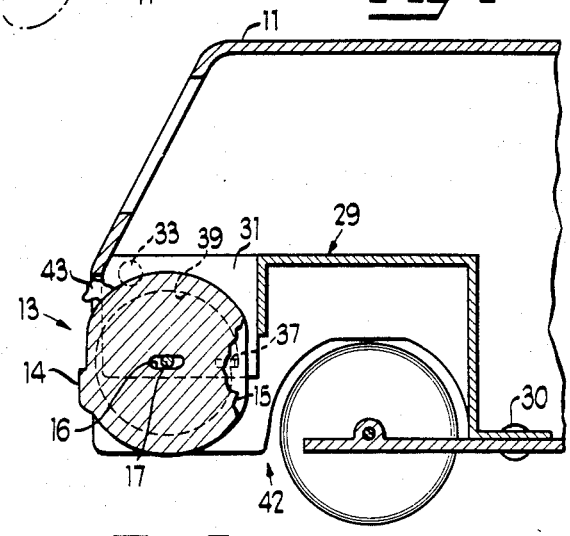
FIG. 4 is an enlarged partial sectional view taken generally along the line 4—4 of FIG. 3.
Figure 5:
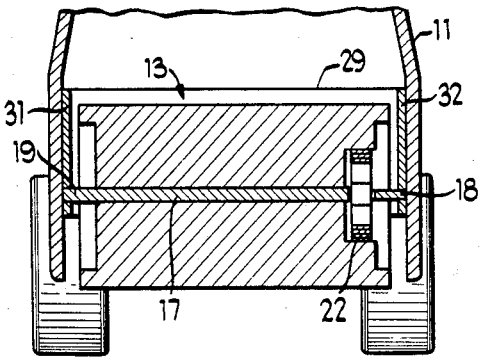
FIG. 5 is an enlarged partial sectional view taken generally along the line 5—5 of FIG. 3.

As shown in FIGS. 3, 4 and 6 the bore 16 is elliptical or elongated in a plane parallel to that in which a major component of force would be expected to be exerted on the bumper and grill assembly in a crash involving that portion of the vehicle. In order to engage or cock the trigger mechanism the part 13 is moved linearly perpendicular to the axis 17 in the opposite direction to that of the major force component. When the vehicle 10 is impacted against a stationary or oncoming object 40 as indicated in FIG. 2, the part 13 is moved back in a direction perpendicular to the axis 17 such that the detents 38 are moved out of engagement with the tabs 37. Coil spring 22 then urges the part 13 to revolve counterclockwise exposing the damaged or dented front bumper and grill side 15 and obscuring the normal section 14 as illustrated in FIG. 2.

If, as shown in FIG. 2, the impacted object 40 has any lower projecting step portion like front bumper 41, an additional advantage is obtained from the counterclockwise revolution of part 13 following impact. As part 13 revolves, the uneven surfaces will grip and climb over the step 41 resulting in the vehicle 10 resting on top of the other vehicle or object with which it has crashed further portraying the effects of a crash or accident.

It will be appreciated that the counterclockwise revolution resulting from the spring biasing force is very fast, causing virtually instantaneous automatic exposure of the dented segment of the vehicle upon impact. In order to avoid the possibility that part of a child's body could be pinched by that rapid revolution of the part 13, it is desirable that the part rotate towards an open or unencumbered portion of the body of the vehicle such as the area 42 indicated in FIG. 4. This opening should be large enough to accommodate a child's finger which also permits pushing the part 13 forward to cock the trigger mechanism.

To facilitate the cocking or triggering of the revolving part it has been found desirable to provide a stop 43 so that the child can better appreciate when the part 13 has been rotated to a position where it can be moved forwardly to engage the detents 38 with the tabs 37. Such a stop may be provided by means of a simulated radiator cap, manufacturer's emblem, hood ornament, or other projecting piece that will contact or abut a fixed part of the toy vehicle such as the hood to restrain further revolution of the part 13 beyond the point at which it is in position to be cocked or triggered by forward linear movement.

The vehicle 10 can be provided with other movable parts for other segments of the body such as the roof, sides, and rear bumper. Where the size and styling of the vehicle body permits, more of such damagable segments can be included. Other toys, such as figures or dolls, may be provided with similar movable parts in portions of the body.

In another embodiment shown in FIGS. 9 through 12 a toy action figure in the form of a knight 50 incorporates the movable part in body 51. The figure 50 may be in a variety of forms, such as, for example, a warrior or fighter of some real or fantasy era, a figure having real or mythical animal features, or even a baby or child doll. Conveniently, the body 51 will include a torso 52 with appendages. Arms 53 may be mounted for movement with respect to the torso and may each have articulated joints such as an elbow 54 as well as a hand 55, or some other suitable extremity. Preferably, the extremities include means for attachment of accessories such as a sword 56 or some other armament. In addition to movable arms 53, the body 51 is conveniently provided with legs 57 which again may be attached for movement with respect to the torso 52. Similar to the arms, the legs may be provided with articulated joints such as knees 58 and have feet 60 suitable for supporting the figure 50 in a posed position. A head 62 is also provided which may or may not be mounted for movement with respect to the torso 52.

As with the vehicle, the body of the figure is provided with a movable part 63 having an exposed surface generally conforming to the contour of the portion of the body containing the movable part. Movable part 63, which is essentially cylindrical, is mounted in the torso 52 behind an opening 64 in the front 65 or chest area and spaced from the back 66. The part is mounted for revolution or rotation about a generally horizontal axis 67 on end stubs 68 and 69 and is also mounted for front-to-back sliding movement along a generally horizontal plane through the axis 67. Substantially parallel, spaced apart, inner mounting plates or walls 70 are secured to the inside of the torso 52 by a suitable adhesive, ultrasonic welding or may be integrally molded as part of the torso. Each of the walls 70 has a horizontally, front to back, elongated slot 71 for receiving the end stubs 68 and 69 to support the part 63 for both rotation and sliding movement from the front 65 towards the back 66.

In the embodiment shown in FIGS. 9 through 12, the surface of the movable part 63 is divided into four basically equal sized circumferential surface sections 74 through 77. Each of the four sections is preferably formed with a face showing a successively greater damaged appearance of the portion of the body represented by the part. Thus, the part 63 has a first section 74 showing an undamaged chest, a second section 75 showing some damage, a third section 76 showing greater damage, and a fourth section 77 showing still greater damage. The part 63 is normally biased, by means of a leaf spring 78 that is affixed at one end to the inside of the back 66 of the torso, toward the front 65 of the chest area of the torso 52 so that one of the quarter sections is exposed through the opening 64.

Rubber band 79 biases the movable part 63 for one way revolution. One end 80 of the rubber band is secured to the inside of the back 66 of the torso and the other end (not shown) is attached to the part 63 on drum 81 adjacent the end stub 68. When the part 63 is rotated in the direction opposite that indicated by the arrow 83 shown in FIGS. 11 and 12, the rubber band 79 is stretched and wound around the drum biasing the part 63 for rotation in the direction of the arrow.

The part 63 urged forward by the leaf spring 78 is cocked or latched against revolution in the direction of the arrow 83 under the force of the rubber band 79. The releasable latch or trigger mechanism comprises a ratchet wheel 85 having four equal spaced cam surfaces or detents 86 that may each engage that projecting tab 88 carried by the body 51 on the inside of the front 65. Thus, when an impact overcomes the bias of leaf spring 78, the part 63 slides back within the slots 71 releasing the trigger mechanism by moving the detent 86 out of engagement with projecting tab 88 and releasing the part 63 to revolve in the direction of arrow 83 for only a quarter revolution to automatically and instantaneously expose the next section of the part 63. Such a force may result from striking the chest including part 63 with a sword 56 or other weapon during a play battle with the action figure. After the blow, spring 78 again urges part 63 forward causing the next detent 86 to engage tab 88. Accordingly, when the part 63 is subjected to successive impacts during the course of a play battle, the part 63 will rotate from the bottom toward the top in progressive steps showing a first wound on section 75, a second wound on section 76, and finally a third wound on section 77.

To facilitate the cocking or triggering of the revolving part 63, a pull string 90 is provided that is attached to one end of the drum 81 and extends through an aperture in the back 66 of the body to a pull ring 91. Pulling the ring 91 rotates the part 63 in the direction opposite the arrow 83 winding and stretching the rubber band biasing force 79. The length of the string 90 is such that it causes a complete counterrevolution of the moving part 63. When the part 63 is impacted and rotates to portray the effect of a blow, the pull string 90 is rewound.

While there have been illustrated and described particular embodiments of the present invention, it will be apparent to those skilled in the art that various changes and modifications may be made without departing from the invention. It is intended in the appended claims to cover all such changes and modifications as fall within the true spirit and scope of the present invention.

What is claimed as new and desired to be secured by Letters Patent is:

1. A toy having a body comprising:

means mounting a part of the body movably with respect to another part of the body so that the movable part is revolvable about an axis;

the movable part having first and second sections one of which is exposed to access and view while the other is obscured;

the first section representing one appearance;

the second section representing another appearance;

positioning means responsive to a force perpendicular to the axis for selectively exposing one section and obscuring the other section and moving the part to expose the other section while obscuring the one section in response to impact upon the part;

the positioning means including biasing means between the parts urging the movable part to revolve about the axis from one position to another;

the positioning means also including releasable latch means restraining the movable part from revolving; and the revolving part being movable perpendicular to the axis of revolution to effect release of the latch means.

2. The toy of claim 1 in which the movable part has a third section representing an additional appearance and the positioning means selectively exposes one of the sections and obscures the other two sections.

3. The toy of claim 2 in which the movable part has a fourth section representing a further appearance and the positioning means selectively exposes one of the sections and obscures the other three sections.

4. The toy of claim 1 in which the positioning means includes other parts of the body of the toy obscuring the unexposed section.

5. The toy claim 1 in which the releasable latch means includes a biasing force normally urging the latch means into engagement.

6. The toy of claim 1 in which the one appearance is an undamaged condition and the other appearance is damaged.

7. The toy of claim 6 in which stop means are provided to prevent revolution of the part past the point at which the undamaged condition is exposed.

8. The toy of claim 1 in which the latch means includes a one way device restraining the movable part from revolving from the undamaged appearance to a damaged appearance.

9. The toy of claim 1 in which the latch means comprises a tab carried by the body and a detent carried by the part that is engagable with the tab.

10. The toy of claim 9 in which the latch means includes a plurality of detents carried by the part and each detent is separately engageable with the tab on the body.

11. An impact responsive toy comprising:

a principal body member;

a part mounted on and forming a segment of the principal body member;

means mounting the part for movement relative to the body member including at least partial revolution about an axis and limited linear movement generally transverse to the axis while containing the part against removal from the body member;

the part having a periphery divided into a number of sections each having a different appearance;

the principal body member obscuring each section other than one and exposing the one section to view and accessibility;

means biasing the part for revolution;

latch means restraining the part from revolution; and the latch means being releasable in response to impact upon the exposed section of the part in a direction transverse to the axis of revolution causing the part to move linearly relative to the mounting means and revolve to expose a previously obscured section and obscure the one section.

12. The toy of claim 11 in which the releasable latch means comprises a projection carried by the body member and engageable with a detent on the part.

13. The toy of claim 11 in which the releasable latch means comprises a tab carried by the body member and an abutment carried by the part that is engageable with the tab.

14. The toy of claim 11 in which stop means are provided to prevent complete revolution of the part, the stop means comprising a projection on the part that contacts a portion of the body member.

15. A toy having a body comprising:

a part contained in and forming a segment of the body;

the part having a number of sections with each section having a different appearance;

means mounting the part for movement relative to the body including at least partial revolution about an axis to selectively expose one of the sections to view and accessibility while obscuring the other of the sections and limited linear movement generally transverse to the axis;

biasing means urging revolution of the part in one direction;

releasable latch means restraining revolution of the biased part; and all said means cooperating so that impact upon the exposed section will move the part linearly to effect release of the latch means and rotationally to expose a previously obscured section of the part.

16. The toy of claim 15 in which the body simulates an animal body and the part is mounted in the chest portion of the body.

17. The toy of claim 15 in which the releasable latch means comprises a projection carried by the body and engageable with a detent on the part.

18. The toy of claim 15 in which the releasable latch means comprises a tab carried by the body and an abutment carried by the part that is engageable with the tab.

19. The toy of claim 15 in which stop means are provided to prevent complete revolution of the part.

20. The toy of claim 19 in which the stop means comprises a projection on the part that contacts a portion of the body.

* * * * *